US012372261B2

(12) United States Patent
Tu et al.

(10) Patent No.: US 12,372,261 B2
(45) Date of Patent: Jul. 29, 2025

(54) FUME HOOD ENERGY USAGE OPTIMIZATION SYSTEM

(71) Applicant: Sustainabli, LLC, Columbia, MD (US)

(72) Inventors: Kevin Jili Tu, Columbia, MD (US); Telon Yan, Bethesda, MD (US); Oliver D'Esposito, Takoma Park, MD (US); Ann-Audrey Ezi, Waldorf, MD (US); Tyler Kiyoshi Colenbrander, Novato, CA (US); Michael Li, Sunnyvale, CA (US)

(73) Assignee: Sustainabli, LLC, Macon, GA (US)

( * ) Notice: Subject to any disclaimer, the term of this patent is extended or adjusted under 35 U.S.C. 154(b) by 154 days.

(21) Appl. No.: 18/492,875

(22) Filed: Oct. 24, 2023

(65) Prior Publication Data

US 2025/0129956 A1 Apr. 24, 2025

(51) Int. Cl.

| | |
|---|---|
| ***F24F 3/163*** | (2021.01) |
| ***F24F 11/46*** | (2018.01) |
| ***F24F 11/52*** | (2018.01) |
| *F24F 120/10* | (2018.01) |
| *F24F 140/40* | (2018.01) |

(52) U.S. Cl.

CPC ..... *F24F 11/46* (2018.01); *F24F 3/163* (2021.01); *F24F 11/52* (2018.01); *F24F 2120/10* (2018.01); *F24F 2140/40* (2018.01)

(58) Field of Classification Search

CPC ..... F24F 11/46; F24F 11/52; F24F 3/163
USPC ..... 340/588
See application file for complete search history.

(56) References Cited

U.S. PATENT DOCUMENTS

| | | | | |
|---|---|---|---|---|
| 9,527,119 | B2 | 12/2016 | Charles | |
| 9,694,398 | B2 | 7/2017 | Stakutis et al. | |
| 2011/0106328 | A1* | 5/2011 | Zhou | G05B 13/024 700/291 |

(Continued)

FOREIGN PATENT DOCUMENTS

AU 2018101644 A4 12/2018

OTHER PUBLICATIONS

Title: Active fume hood sash height monitoring with audible feedback, available on: https://www.sciencedirect.com/science/article/pii/S2352484718302634 with 8 pages.

(Continued)

*Primary Examiner* — Jack K Wang
(74) *Attorney, Agent, or Firm* — Jeremy Briggs

(57) ABSTRACT

A system to optimize energy usage associated with a fume hood is disclosed. The system may include a transceiver and a processor. The transceiver may be configured to receive inputs from a detection unit. The processor may obtain the inputs from the transceiver. Responsive to obtaining the inputs, the processor may determine that an extent of open state of a window associated with an enclosure may be greater than a predefined threshold for a predefined time duration and an absence of a user in proximity to the enclosure for the predefined time duration based on the inputs. The processor may further determine a total time duration the extent of open state is greater than the predefined threshold. Furthermore, the processor may calculate an estimated energy loss associated with the enclosure based on the extent of open state and the total time duration, and then output the estimated energy loss.

20 Claims, 5 Drawing Sheets

(56) References Cited

U.S. PATENT DOCUMENTS

| | | | | |
|---|---|---|---|---|
| 2016/0323393 | A1* | 11/2016 | Umphreys | G06Q 10/04 |
| 2017/0361365 | A1* | 12/2017 | Singh | B08B 15/023 |
| 2020/0011005 | A1* | 1/2020 | Okumura | F24D 15/00 |
| 2021/0302052 | A1* | 9/2021 | Trinh | F24F 11/0008 |
| 2023/0278081 | A1* | 9/2023 | Aniulis | B08B 15/023 454/56 |

OTHER PUBLICATIONS

Title: Motion and Sash Height (MASH) alarms for efficient fume hood use, available on: https://www.nature.com/articles/s41598-021-00772-y with 8 pages.
Title: Confidence in managing laboratory fume hoods, available on: https://www.eurotherm.com/?wpdmdl=119433 with 8 pages.

* cited by examiner

FUME HOOD ENERGY USAGE OPTIMIZATION SYSTEM

TECHNICAL FIELD

The present disclosure relates to a fume hood energy usage optimization system and more particularly to a fume hood energy usage optimization system configured to detect an open state of a fume hood sash window when the fume hood is not in use and incentivize optimum fume hood usage.

BACKGROUND

Fume hoods are typically used in educational, industrial, medical and government laboratories and production facilities where users are required to work with chemicals that may emit toxic fumes. A fume hood is a work area where a user may experiment with chemicals. A conventional fume hood includes an enclosure with an opening. The chemicals are typically housed within the enclosure to ensure that the toxic fumes do not escape the fume hood and into the lab/building that houses the fume hood. The opening is generally covered with an openable sash window. The user may open the sash window when the user desires to access an enclosure interior portion and experiment with the chemicals.

The fume hood enclosure is typically ventilated by using fans or a ventilation unit. The ventilation unit/fans extract air (e.g., conditioned air) from a lab or building interior portion and exhaust the air to outside the lab/building, thereby ensuring that the toxic fumes in the enclosure interior portion are also exhausted out of the fume hood. While the ventilation unit operation is important to ensure that the toxic fumes move out of the fume hood and do not enter the lab/building interior portion, excess ventilation unit usage may result in energy wastage.

Therefore, a system is required that optimizes fume hood usage, and hence ventilation unit's operation.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
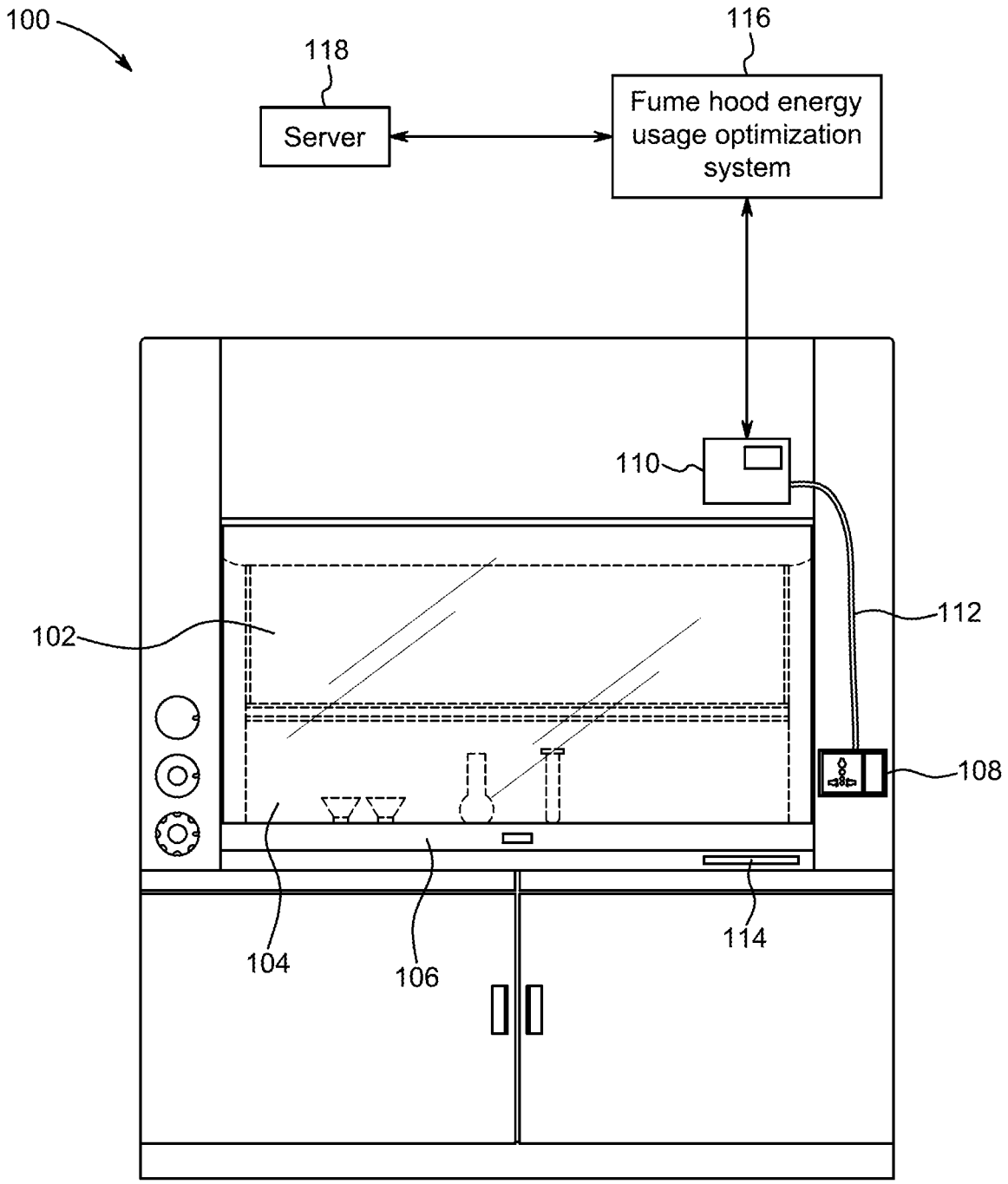
FIG. 1 depicts an example first environment in which techniques and structures for providing the systems and methods disclosed herein may be implemented.

The present disclosure describes a system for optimizing fume hood energy usage. The system may be configured to alert a user when a sash window associated with a fume hood may be left open during non-operation of the fume hood. Responsive to receiving the alert from the system, the user may close the sash window when the fume hood may not be in use, thereby conserving energy that may have been unnecessarily consumed to operate fume hood ventilation unit/fans, one or more lights, etc., due to the sash window open state.

The system may be configured to obtain inputs from a detection unit that may be disposed on or in proximity to the fume hood. The detection unit may include one or more sensors and/or cameras, and may be configured to detect an extent of sash window opening (or an extent of sash window open state). The detection unit may be further configured to detect a user presence or absence in proximity to the fume hood. Responsive to obtaining the inputs from the detection unit, the system may determine if the sash window may be open for more than a predefined window opening threshold (e.g., the window may be more than 60% open) and for more than a predefined time duration (e.g., for more than 10-15 minutes) when the user may not be present in proximity to the fume hood. Responsive to such determination, the system may output an alert notification to the user and/or a lab operator, indicating that the sash window should be closed to conserve energy.

The system may be further configured to calculate an estimated energy usage or energy loss associated with the fume hood due to the sash window open state (e.g., when the fume hood may not be in use). The system may output the estimated energy usage or energy loss to a system memory or a server for storage purposes. The user may access the system memory or the server to view statistics associated with fume hood energy usage, air flow from the fume hood, and/or the like. The system may further facilitate the lab operator to run competitions across a university/research facility (that may include a plurality of fume hoods) to reward or incentivize those users who may regularly close respective sash windows after using the fume hoods, thereby assisting in conserving research organization energy consumption.

The system may be further configured to output energy usage reports as per regulatory guidelines. The system may be additionally configured to determine a state of fume hood interior portion after the user uses the fume hood, and output alert notifications when the user leaves leftover chemicals in the fume hood interior portion after fume hood usage and/or keeps the fume hood in an unclean state. The system may be further configured to authenticate the user before the user uses the fume hood, and may enable fume hood access to only authenticated users.

The present disclosure discloses a system that optimizes energy usage associated with a fume hood. The system alerts the user and/or the lab operator when the sash window may be inadvertently left open or when the energy consumption associated with the fume hood increases beyond a predefined threshold value, thereby assisting in energy conservation. The system is easy to install, lightweight and inexpensive.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

FIG. 1 depicts an example first environment 100 in which techniques and structures for providing the systems and methods disclosed herein may be implemented. The environment 100 may include an enclosure 102 having an openable window 104. In some aspects, the enclosure 102 may be a fume hood and the window 104 may be a sash window. Hereinafter, the enclosure 102 is referred to as fume hood 102.

The fume hood 102 may be located in a lab/building (not shown), and may be used by one or more users to experiment with chemicals that emit toxic fumes. The fume hood 102 may include top, bottom and side walls that may not enable the toxic fumes to escape. The fume hood 102 may include an enclosure/fume hood opening in a fume hood front portion through which a user may access a fume hood interior portion, in which the user may place the chemicals and experiment with the chemicals. The window 104 may be configured to provide access to the fume hood interior portion via the fume hood opening to the user. Specifically, the user may move the window 104 to an open state when the user desires to access the fume hood interior portion. In this case, the window 104 may provide access to the fume hood interior portion via the fume hood opening to the user when the window 104 may be moved to the open state.

In some aspects, the window 104 may be a "vertically movable" window that may move to the open state when the user slides the window 104 vertically upwards along a fume hood height. Similarly, the user may slide the window 104 vertically downwards along the fume hood height to move the window 104 to a closed state. In some aspects, a window bottom edge or panel 106 may be disposed in proximity to a fume hood bottom portion when the window 104 may be in the closed position, as shown in FIG. 1. Similarly, the window bottom panel 106 may be disposed away from the fume hood bottom portion when the window 104 may be in the open position. In some aspects, the window 104 may cover an entire area (e.g., 100% area) of the fume hood opening when the window 104 may be in the closed position.

The fume hood 102 may further include a plurality of additional units including, but not limited to, a ventilation unit/fans (not shown) disposed in the fume hood interior portion, one or more lights disposed in the fume hood interior portion, one or more power sockets 108, and/or the like. The ventilation unit may be configured to extract air from a lab interior portion (where the fume hood 102 may be located) and exhaust the extracted air to outside the lab via the fume hood interior portion, thereby removing the toxic fumes present in the fume hood interior portion. In some aspects, the ventilation unit may operate when the window 104 may be in the open state and may not operate when the window 104 may be in the closed state. Further, a rate of air extraction from the lab interior portion by the ventilation unit (or an "air flow rate" due to fan speed) may depend on the extent of window opening. For example, the air flow rate may be low when the window 104 may be 50% open, as compared to the air flow rate when the window 104 may be 80% open. In some aspects, the ventilation unit may automatically regulate the air flow rate based on the extent of window opening. In this case, the fume hood 102 may be a variable air volume fume hood. In other aspects, the fume hood 102 may be a constant air volume fume hood.

A person ordinarily skilled in the art may appreciate that the ventilation unit may consume more energy to operate when the air flow rate (or the fan speed) may be high. Therefore, energy consumed by the fume hood 102 may be high when the extent of window opening may be high, as compared to energy consumed when the extent of window opening may be low. Furthermore, the lights disposed in the fume hood interior portion may automatically switch ON when the window 104 may be moved to the open state, to enable the user to conveniently experiment with the chemicals in the fume hood interior portion. Switching the lights ON may further cause the energy consumption from the fume hood 102 to increase.

The power socket 108 may be configured to power one or more external devices/systems/units that may be electrically coupled with the fume hood 102. For example, the power socket 108 may provide power/energy to a detection unit 110 via a power cord 112. The detection unit 110 may be disposed anywhere on the fume hood 102 in proximity to the window 104. In the exemplary aspect depicted in FIG. 1, the detection unit 110 is disposed in proximity to a top front portion of the fume hood opening above the window 104, although the present disclosure is not limited to such an arrangement of the detection unit 110.

The detection unit 110 may include a plurality of sensors, and may be configured to detect an extent of an open state of the window 104 associated with the fume hood 102. For example, the detection unit 110 may detect that the window 104 may be 60% open when the window panel 106 may be located at a position/height that may be 40% of the fume hood height from the top front portion of the fume hood opening. Similarly, the detection unit 110 may detect that the window 104 may be 80% open when the window panel 106 may be located at a position/height that may be 20% of the fume hood height from the top front portion of the fume hood opening.

The detection unit 110 may be further configured to detect a presence or an absence of a user in proximity to the fume hood 102. The detection unit 110 may additionally detect a distance of the user from the fume hood front portion, when the detection unit 110 detects that the user may be located in proximity to the fume hood 102. The detection unit 110 may be additionally configured to detect a real-time state of the fume hood interior portion. For example, the detection unit 110 may detect whether any chemical (or an object) may be left behind in the fume hood interior portion when the window 104 may be in the closed state. Similarly, the detection unit 110 may detect if the fume hood interior portion may be clean (i.e., does not include any unused chemicals) when the window 104 may be in the closed state or when the fume hood 102 may not be in use.

Examples of the plurality of sensors included in the detection unit 110 include, but are not limited to, an ultrasonic sensor, an infrared sensor, a time of flight (TOF) sensor, a Red-Green-Blue (RGB) camera, an infrared camera, an accelerometer, a linear encoder, and a Light Detection and Ranging (lidar) sensor.

In some aspects, a reflector plate 114 may be disposed on the window panel 106 that may assist the detection unit 110 to detect the extent of window open state. Specifically, to detect the extent of window open state, the detection unit 110 may transmit signals (e.g., sonic signals, infrared signals, etc.) towards the reflector plate 114, which may reflect the signals back to the detection unit 110. The detection unit 110 may detect the extent of window open state based on a time duration taken by the signals to reach to the reflector plate 114 and then to reflect back to the detection unit 110.

In some aspects, when the detection unit 110 may be getting installed on the fume hood 102, the user may "calibrate" different positions of the reflector plate 114 (and hence the window panel 106) relative to the detection unit 110, so that the detection unit 110 may efficiently detect the extent of window open state during operation. For example, the user may calibrate a fully closed state associated with the window 104 by causing the detection unit 110 to transmit a signal to the reflector plate 114 when the window 104 may be fully closed, and causing the detection unit 110 to measure the time duration taken by the signal to reach to the reflector plate 114 and to reflect back. The detection unit 110 may calibrate the fully closed window state by measuring the time duration described above. During operation, whenever similar time duration may be measured by the detection unit 110, the detection unit 110 may detect that the window 104 may be fully closed. In a similar manner, other window positions (e.g., when the window 104 may be 20%, 40%, 60%, 80% closed or open) may be calibrated for the detection unit 110 during the installation process.

The environment 100 may further include a fume hood energy usage optimization system 116 (or system 116) that may be communicatively coupled with the detection unit 110 and/or a server 118. In some aspects, the system 116 may be part of the detection unit 110. In other aspects, the system 116 may be part of the server 118.

The system 116 may be configured to facilitate users, lab operators, etc. to optimize energy usage (and spend) associated with the fume hood 102. Specifically, the system 116 may be configured to determine when the window 104 may be left inadvertently open (i.e., in the open state) by the user when the fume hood 102 may not be in use. Responsive to such determination, the system 116 may output visual and/or audible alarms to alert the user and/or the lab operator to close the window 104, thereby conserving energy that may have been spent in operating the ventilation unit, the lights, etc. disposed in the fume hood interior portion. The system 116 may be further configured to determine/estimate/monitor energy usage associated with the fume hood 102 and/or energy loss associated with the fume hood 102 when the window 104 may be left open. Responsive to determining the energy usage and/or the energy loss, the system 116 may determine whether the fume hood 102 may be efficiently used or may not be optimally used. When the fume hood 102 may not be optimally used, the system 116 may output recommendations or notifications indicating to the user(s) and building managers operating and maintaining the fume hood 102 to regularly close the window 104 after using the fume hood 102.

The system 116 may further facilitate in executing an energy usage competition across university/research facility, thereby incentivizing users to regularly close sash windows associated with the fume hoods installed in the university/research facility after usage. In this case, the system 116 may determine/estimate energy usage or energy loss associated with a plurality of fume hoods installed in the university/research facility. The users associated with those fume hoods that have low associated energy usage/energy loss (e.g., less than a first predefined energy threshold) may be competition winners. In some aspects, the winners may also be decided based on other parameters such as, an average time duration per day the sash window was left in the open state when no user was in proximity to the fume hood, an average extent of window open state on each day, and/or the like.

The system 116 may be additionally configured to determine whether the user using the fume hood 102 may be keeping the fume hood 102 clean or leaving unused chemicals in the fume hood interior portion when the fume hood 102 may not be in use. Responsive to determining that the user may be leaving unused chemicals in the fume hood interior portion, the system 116 may transmit notifications to the user and/or the lab operator (specifically to their respective user devices) indicating that the fume hood 102 may be left in sub-optimal state.

Further, the system 116 may be configured to use historical energy usage or energy loss information associated with the fume hood 102 and "predict" a future energy usage or loss associated with the fume hood 102 based on the historical energy usage or energy loss information. The system 116 may output a notification to the user who may be using the fume hood 102 in the future requesting the user to close the window 104 after using the fume hood 102, when the predicted future energy usage/loss may be greater than a threshold value.

The system 116 may be additionally configured to authenticate the user using the fume hood 102 and enable access to the fume hood 102 for the user based on the authentication. Furthermore, the system 116 may enable access to the fume hood 102 for the user based on time of day or a predefined time duration to use the fume hood 102 that may be pre-booked by the user on the system 116 (e.g., on a Calendar associated with the system 116).

Details of the system 116 are described later in the description below in conjunction with FIG. 3.

Although the description above describes an aspect where the enclosure 102 is a fume hood, in some aspects, the enclosure 102 may be a lab and the openable window 104 may be a lab door, without departing from the present disclosure scope. Furthermore, although the description above describes an aspect where the window 104 is a vertically movable window, in some aspects, the window 104 may be a horizontally or laterally movable window, without departing from the present disclosure scope.

Although the description above describes an aspect where the detection unit 110 is powered via the power socket 108 and the power cord 112, the present disclosure is not limited to such an aspect. In some aspects, the detection unit 110 may include an in-built battery that may power the detection unit 110.

Figure 2:
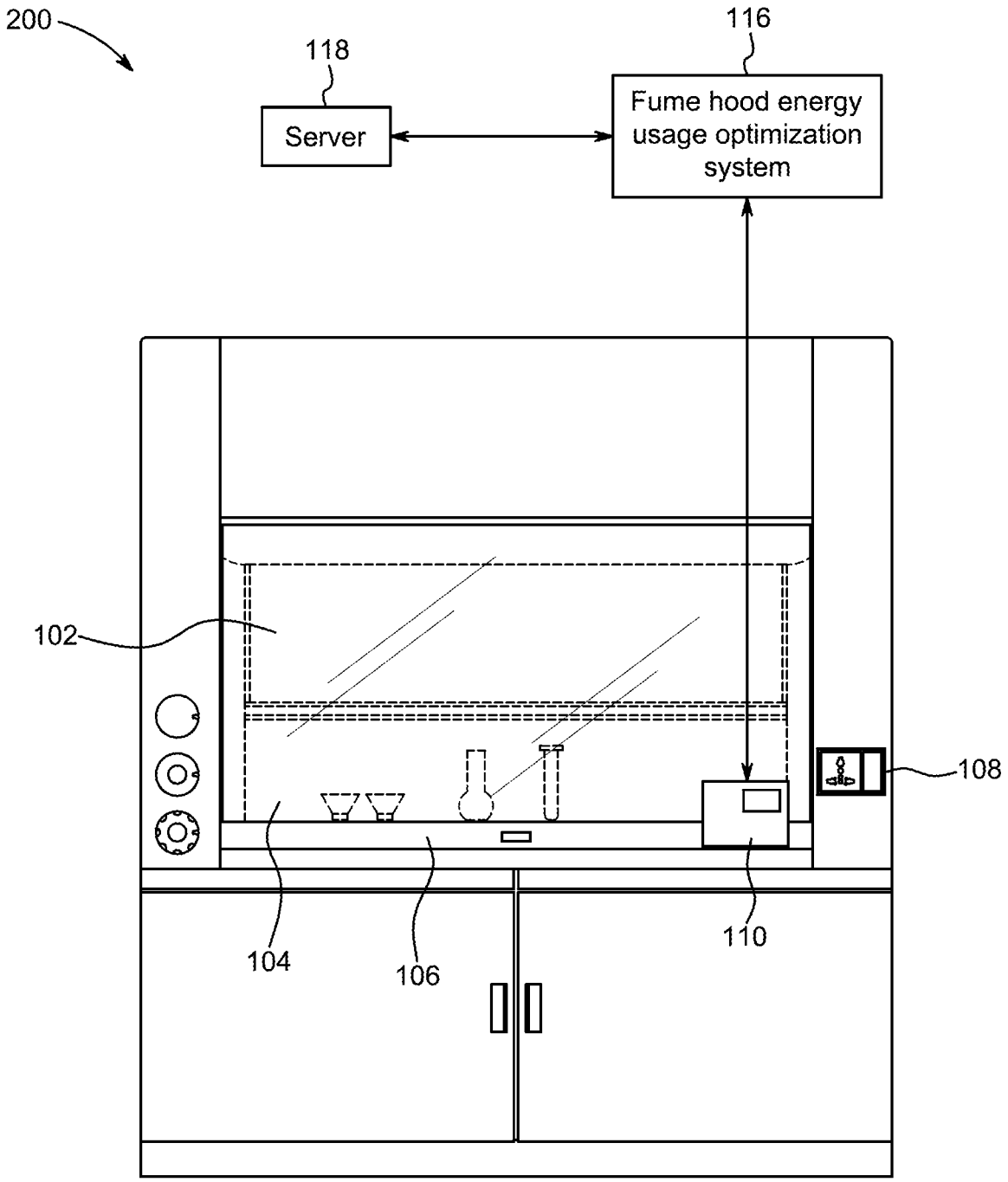
FIG. 2 depicts an example second environment in which techniques and structures for providing the systems and methods disclosed herein may be implemented.

FIG. 2 depicts an example second environment 200 in which techniques and structures for providing the systems and methods disclosed herein may be implemented. The environment 200 may include the same components/units as the components/units described above in conjunction with FIG. 1; however, in the exemplary aspect depicted in the environment 200, the reflector plate 114 may not be there, and the detection unit 110 may be disposed on the window panel 106. In this case, the detection unit 110 may include camera(s) (as opposed to ultrasonic or Infrared sensors), and the detection unit 110 may perform the functions described above in conjunction with FIG. 1 based on images obtained from the camera(s). In other aspects, the detection unit 110 may include an accelerometer that may be used to measure distance by first calibrating the position of the detection unit 110 to a pre-specified position, e.g. when the window 104 may be 0% open (or 100% closed). In this case, the system 116 may calculate numerical double integration by using the acceleration readings/data obtained from the accelerometer to continuously update calculations associated with the window open state (e.g., to determine the percentage opening of the window 104). A person ordinarily skilled in the art may appreciate that numerical integration may be associated with a margin of error, and hence the system 116 may implement additional algorithms, in particular filtering algorithms, to improve the calculations described above associated with the window open state. In some aspects, the system 116 may use low pass filters and Kalman filters for reducing noise and smoothing out calculations associated with the window open state over time. Furthermore, the accelerometer may also be used to minimize power usage by detecting motion, initializing a low power mode when stationary, when the device may not need to collect data.

In some aspects, in the aspect depicted in FIG. 2, the detection unit 110 may include batteries (not shown), and may not be powered by the power socket 108 via the power cord 112. In other aspects, the detection unit 110 shown in FIG. 2 may not include batteries, and may be powered by the power socket 108 via the power cord 112. In further aspects, the batteries included in the detection unit 110 may be charged via the power socket 108 and the power cord 112 or via a wireless proximity charger (not shown).

In some aspects, for the exemplary depiction shown in FIG. 2, when the detection unit 110 includes an accelerometer to measure the window open state, a separate sensor pair 111 such as, but not limited to, a magnetic reed switch or pogo pins, may be placed at the bottom portion of the fume hood 102 to calibrate the sensors on the detection unit 110 as the baseline of 0% open window 104. One of the sensors of the sensor pair 111 may be mounted to a static position on the fume hood 102, and the other sensor may be mounted on the detection unit 110. Only when the window 104 may be fully closed, the detection unit 110 will reach the bottom of the fume hood 102, and the sensor pair 111 will be close enough to trigger a signal in the detection unit 110. This will regularly recalibrate the accelerometer estimation (override the current openness estimation by setting it to 0% open), which may be necessary to preserve accuracy as estimation errors accumulate over time. In some aspects, if the detection unit 110 is battery-powered, the pogo pin may be used to recharge the batteries.

In other aspects (not shown), the sensor pair 111 may not be required to be placed at the bottom portion of the fume hood 102, when the detection unit 110 includes an accelerometer, and one or more time-of-flight (TOF) or lidar sensors are used to calibrate the accelerometer. In this case, the TOF or lidar sensors may be part of the detection unit 110, and may not be needed to be adhered to the bottom portion of the fume hood 102.

In yet another aspect (not shown), a linear encoder may additionally or alternatively (instead of or in addition to an accelerometer) may be used to measure the openness of the window 104. To do this, the detection unit 110 may be mounted on the bottom of the fume hood 102 and close to the sides of the window panel 106. Directly next to the window panel 106 (and on the body of the fume hood 102 itself), a linear encoder target may be mounted. On the detection unit 110, a sensor may be mounted facing the linear encoder target. As the window panel 106 moves up and down, the sensor may observe changes in the target, from which the detection unit 110 may determine window panel height, and hence openness of the window 104. Alternatively, a stationary encoder may also be placed near the top of the fume hood 102, on the side, with the target directly on the sash window of the fume hood 102. In this exemplary aspect as well, the sensor pair 111 may not be required.

Since the detection unit 110 is disposed on the window panel 106 in the exemplary aspect depicted in FIG. 2, the detection unit 110 may move vertically up or down when the window 104 may be opened or closed by the user. Having batteries included in the detection unit 110 (as opposed to getting powered by the power socket 108 via the power cord 112) facilitates efficient detection unit movement, without risking tangling of the power cord 112.

The remaining units depicted in FIG. 2 are the same as the units depicted in FIG. 1, and hence are not described again here for the sake of simplicity and conciseness.

Figure 3:
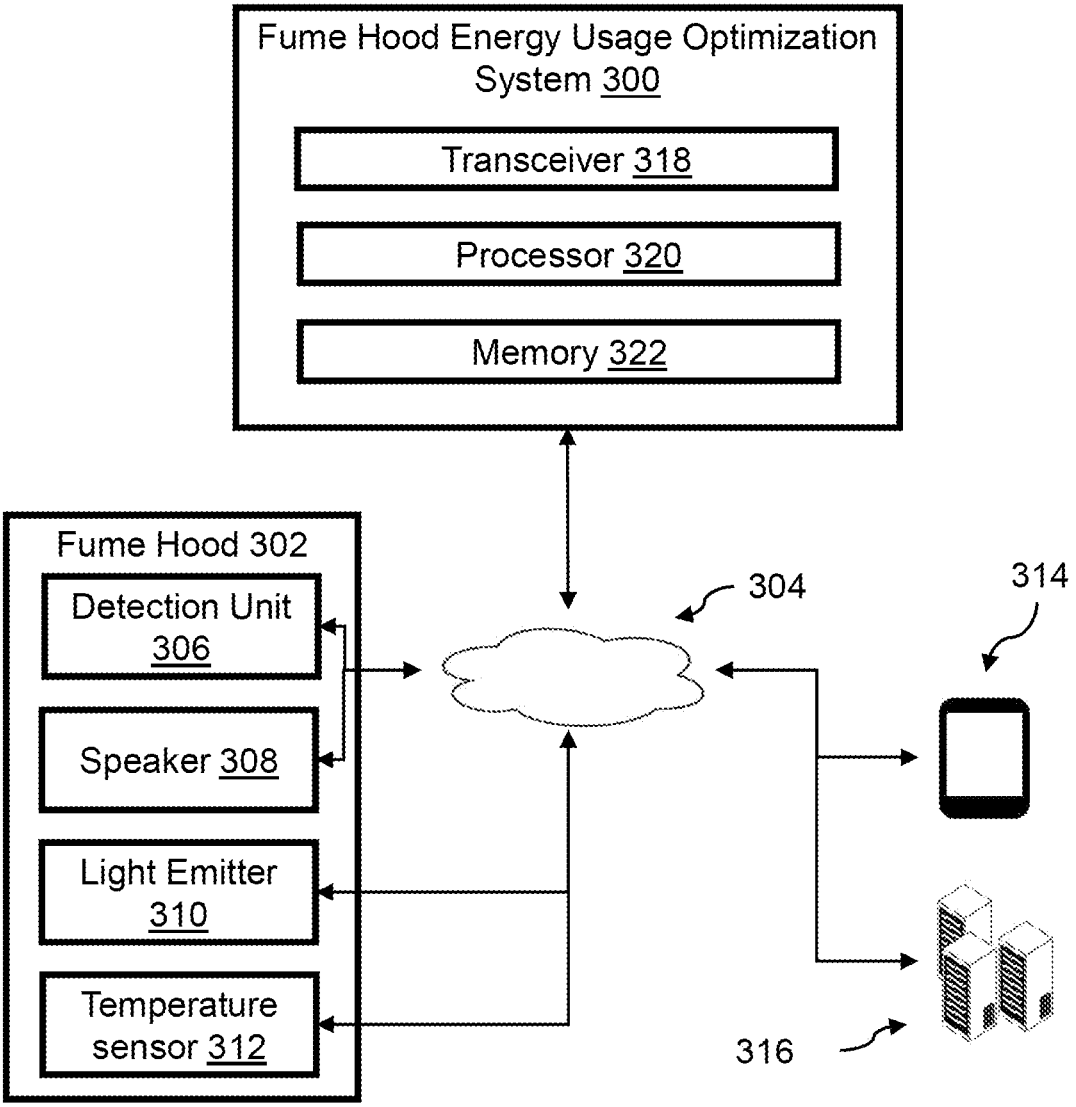
FIG. 3 depicts a block diagram of an example fume hood energy usage optimization system in accordance with the present disclosure.

FIG. 3 depicts a block diagram of an example fume hood energy usage optimization system 300 (or system 300) in accordance with the present disclosure. The system 300 may be the same as the system 116 described above in conjunction with FIG. 1. The system 300, as described herein, may be implemented in hardware, software (e.g., firmware), or a combination thereof. While describing FIG. 3, references will be made to FIG. 4.

The system 300 may be communicatively coupled with a plurality of units disposed on or in proximity to a fume hood 302 (that may be same as the fume hood 102) via one or networks 304. The plurality of units may be, for example, a detection unit 306, a speaker 308, a light emitter 310, and a temperature sensor 312. The detection unit 306 may be the same as the detection unit 110. The system 300 may use the speaker 308 and the light emitter 310 to output audible and visual notifications. In some aspects, the light emitter 310 may include light emitting diodes (LEDs). The temperature sensor 312 may be configured to detect a real-time temperature in proximity to the fume hood 302.

Although the system 300 is shown as being communicatively coupled with units associated with a single fume hood 302, the system 300 may be communicatively coupled with units of a plurality of fume hoods simultaneously (e.g., a plurality of fume hoods associated with a university or a research facility). The system 300 may further be communicatively coupled with a user device 314 and a server 316 via the network 304. The user device 314 may be associated with a fume hood user or a lab operator associated with a lab that houses the fume hood 302. In some aspects, the system 300 may be part of the server 316. In other aspects, the system 300 may be part of the detection unit 306.

The network 304 may be, for example, a communication infrastructure in which the connected devices discussed in various embodiments of this disclosure may communicate. The network 304 may be and/or include the Internet, a private network, public network or other configuration that operates using any one or more known communication protocols such as, for example, transmission control protocol/Internet protocol (TCP/IP), Bluetooth®, BLE®, Wi-Fi based on the Institute of Electrical and Electronics Engineers (IEEE) standard 802.11, UWB, and cellular technologies such as Time Division Multiple Access (TDMA), Code Division Multiple Access (CDMA), High Speed Packet Access (HSPDA), Long-Term Evolution (LTE), Global System for Mobile Communications (GSM), and Fifth Generation (5G), to name a few examples.

The system 300 may include a plurality of units including, but not limited to, a transceiver 318, a processor 320 and a memory 322. The transceiver 318 may be configured to receive/transmit data, notifications, information, signals, etc. from/to one or more devices or systems via the network 304.

The memory 322 may store programs in code and/or store data for performing various system operations in accordance with the present disclosure. Specifically, the processor 320 may be configured and/or programmed to execute computer-executable instructions stored in the memory 322 for performing various system functions in accordance with the disclosure. Consequently, the memory 322 may be used for storing code and/or data code and/or data for performing operations in accordance with the present disclosure.

In one or more aspects, the processor 320 may be disposed in communication with one or more memory devices (e.g., the memory 322 and/or one or more external databases (not shown in FIG. 3)). The memory 322 may include any one or a combination of volatile memory elements (e.g., dynamic random-access memory (DRAM), synchronous dynamic random access memory (SDRAM), etc.) and can include any one or more nonvolatile memory elements (e.g., erasable programmable read-only memory (EPROM), flash memory, electronically erasable programmable read-only memory (EEPROM), programmable read-only memory (PROM), etc.).

The memory 322 may be one example of a non-transitory computer-readable medium and may be used to store programs in code and/or to store data for performing various operations in accordance with the disclosure. The instructions in the memory 322 may include one or more separate programs, each of which may include an ordered listing of computer-executable instructions for implementing logical functions.

In operation, the transceiver 318 may receive inputs from the detection unit 306 via the network 304. Specifically, the transceiver 318 may receive sensor inputs from the sensors included in the detection unit 306 and/or images from one or more cameras included in the detection unit 306. The transceiver 318 may further receive information associated with a real-time temperature in proximity to the fume hood 302 from the temperature sensor 312. Specifically, the transceiver 318 may receive information associated with a real-time temperature of a lab interior portion where the fume hood 302 may be located.

Responsive to receiving the information/inputs described above, the transceiver 318 may transmit the information/inputs to the memory 322 for storage purpose and to the processor 320. The processor 320 may obtain the inputs from the transceiver 318 (that the transceiver 318 receives from the detection unit 306) and determine the extent of window opening (or the extent of window open state) based on the obtained inputs. For example, the processor 320 may determine whether the window 104 may be 30% open, 60% open or 90% open, based on the obtained inputs. The processor 320 may further determine whether a user may be present in proximity to the fume hood 302 based on the obtained inputs.

Responsive to determining that the extent of window opening may be greater than a first predefined threshold (e.g., 5% or 10% open) and a user absence in proximity to the fume hood 302, the processor 320 may determine a time duration (e.g., a first time duration) for which the extent of window opening may be greater than the first predefined threshold and the user may be absent from the fume hood 302. The processor 320 may output/transmit, via the transceiver 318, a first notification when the processor 320 determines that the extent of window opening may be greater than the first predefined threshold for a predefined time duration (e.g., 10-15 minutes) and the user may be absent from the fume hood 302.

In other aspects, responsive to determining that the extent of window opening may be greater than a second predefined threshold (e.g., 60% or 70% open) and a user presence in proximity to the fume hood 302, the processor 320 may determine a time duration (e.g., a second time duration) for which the extent of window opening may be greater than the second predefined threshold and the user may be present near the fume hood 302. The processor 320 may output/transmit, via the transceiver 318, the first notification when the processor 320 determines that the extent of window opening may be greater than the second predefined threshold for a predefined time duration (e.g., 10-15 minutes) and the user may be present near the fume hood 302. Stated another way, in this case, the processor 320 may still output the first notification when the extent of window opening may be greater than 60% or 70%, although the user may be present near the fume hood 302.

In an exemplary aspect, the processor 320 may determine that the extent of window opening may be greater than the first predefined threshold when the window 104 may be at least 60% open. Stated another way, the processor 320 may determine that the extent of window opening may be greater than the first predefined threshold when the window 104 covers less than 40% of a total area of the fume hood opening. Further, the processor 320 may output the first notification via the speaker 308 (as an audible notification) and/or the light emitter 310 (as a visual notification). The processor 320 may additionally output/transmit, via the transceiver 318, the first notification via the user device 314. The first notification may indicate to the user and/or the lab operator that the window 104 may have been left in the open state when the fume hood 302 may not in use, thereby resulting in energy loss/wastage (e.g., due to the operation of ventilation unit, lights, etc., which may not be required to operate when the fume hood 302 is not used). The user and/or the lab operator may hear/view the first notification and may accordingly move the window 104 to the closed state, thereby preventing or minimizing energy loss.

Furthermore, responsive to determining that the extent of window opening may be greater than the first or second predefined thresholds for the predefined time duration and the user may or may not be present in proximity to the fume hood 302, the processor 320 may determine a first or second total time durations for which the window 104 may be left in the open state (e.g., a total time duration for which the extent of window opening may be greater than the first or second predefined thresholds) when the user may or may not be absent from the fume hood 302. For example, the processor 320 may determine a first total time duration the extent of window open state may be greater than the first predefined threshold, responsive to a determination that the extent of window open state may greater than the first predefined threshold for the predefined time duration and the user may not be present in proximity to the fume hood 302. Similarly, the processor 320 may determine a second total time duration the extent of window open state may be greater than the second predefined threshold, responsive to a determination that the extent of window open state may be greater than the second predefined threshold for the predefined time duration and the user may be present in proximity to the fume hood 302.

The processor 320 may further determine an air flow (or air flow rate) from the fume hood 302 (because of ventilation unit operation) based on the extent of window opening and the determined first or second total time durations. In this case, the processor 320 may use a data structure including a mapping of historical air flow rates from the fume hood 302 for different extents of window opening (e.g., for 20%, 40%, 60%, 80%, etc. window opening), which may be pre-stored in the memory 322 or the server 316. Based on the mapping, the processor 320 may determine the air flow that may have been exhausted from the lab interior portion to the outside of the lab via the fume hood interior portion, because the window 104 was left open.

A person ordinarily skilled in the art may appreciate that the air in the lab interior portion is typically conditioned, e.g., by using a heating, ventilation, and air conditioning (HVAC) system, and hence if the air is unnecessarily exhausted out of the lab interior portion due to inadvertent sash window opening, the HVAC system may be required to operate additionally (and unnecessarily) to condition "new" air that may replace the exhausted air. Therefore, along with unnecessary operation of the ventilation unit and lights disposed in the fume hood interior portion, the lab HVAC system too may be required to operate additionally (and unnecessarily) when the window 104 may be inadvertently left open when the fume hood 302 may not be in use. Energy usage by the HVAC system may further increase considerably if the ambient temperature and/or the real-time temperature in proximity to the fume hood 302 may be high, as the AC may be required to expend additional energy to bring the "high" temperature down to a permissible or user desired lab temperature.

In some aspects, the processor 320 may determine/calculate an estimated energy usage or energy loss (e.g., first or second estimated energy loss) associated with the fume hood 302 based on the determined air flow or air flow rate, the real-time temperature in proximity to the fume hood 302 (that the processor 320 may obtain from the temperature sensor 312), the extent of window opening and the first or second total time durations for which the window 104 was inadvertently left open. The first estimated energy loss may be associated with the first total time duration and the second estimated energy loss may be associated with the second total time duration. In some aspects, the estimated energy usage or energy loss may be high when the extent of window opening may be high and/or the total time duration for which the window 104 was inadvertently left open may be high, as the ventilation unit, lights, etc. may utilize a higher amount of energy (e.g., unnecessary energy) during these time durations to operate. Further, the estimated energy usage or energy loss may be high when the real-time temperature (or ambient temperature) and/or the determined air flow may be high, as the HVAC system may be required to utilize more energy during such time durations.

Responsive to determining/calculating the first or second estimated energy usage or energy loss as described above, the processor 320 may output/transmit the first or second estimated energy usage or energy loss to the memory 322 or the server 316 for storage purpose.

Although the description above describes an aspect where the processor 320 calculates the estimated energy usage associated with the fume hood 302 when the window 104 may be left open above the first and second predefined thresholds and the user may or may not be away from the fume hood 302, in some aspects, the processor 320 may calculate the estimated energy usage associated with the fume hood 302 at other times as well, e.g., when the window 104 may be open below the first or second predefined thresholds and/or when the user may or may not be present in proximity to the fume hood 302. In this case as well, the processor 320 may transmit the estimated energy usage to the memory 322 or the server 316 for storage purposes. In a similar manner, the processor 320 may calculate energy usage information associated with a plurality of fume hoods that may be present in the university/research facility, and store the energy usage information in the memory 322 or the server 316.

Figure 4:
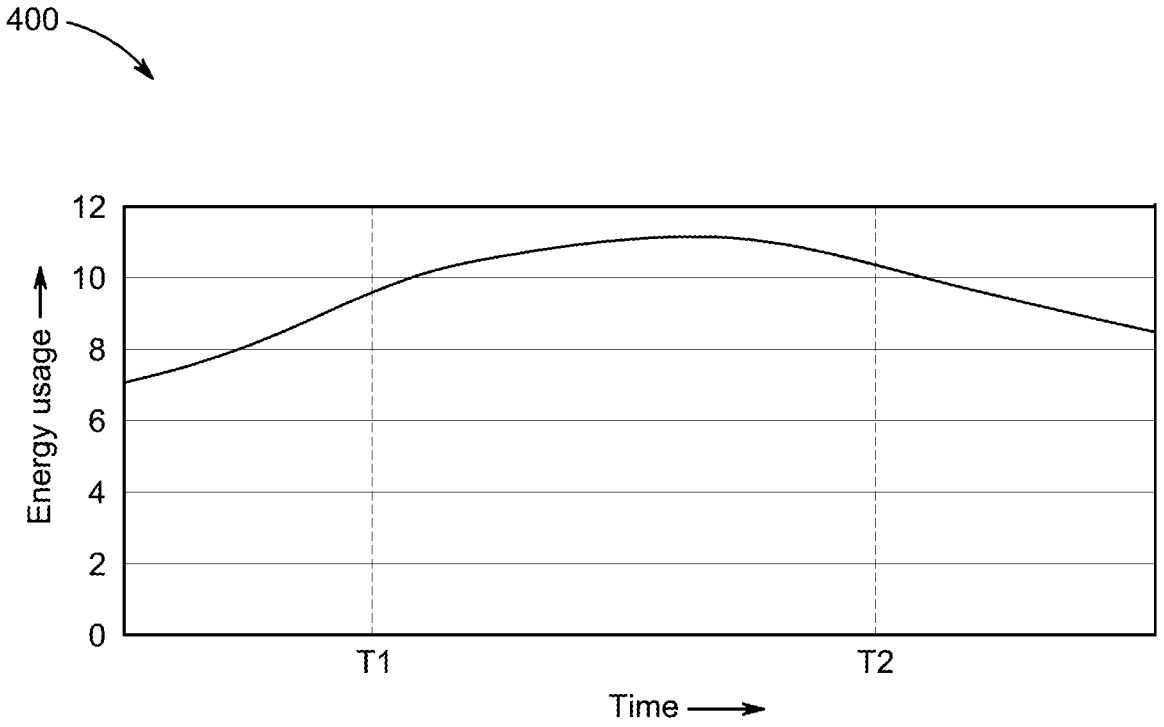
FIG. 4 depicts an example graph depicting fume hood energy usage with time in accordance with the present disclosure.

The user and/or the lab operator may access the system 300 or the server 316 at any time to view the energy usage information associated with the fume hood 302 (and other fume hoods located in the university/research facility). An example graph 400 depicting energy usage associated with the fume hood 302 with time is shown in FIG. 4. Graph Y-axis depicts energy usage (e.g., in KW) and graph X-axis depicts time. As shown in the graph 400, energy usage associated with the fume hood 302 may be high between times "T1" and "T2", and may be relatively lower before the time "T1" and after the time "T2".

The processor 320 may similarly calculate and store in the memory 322 or the server 316 other parameters associated with the fume hood 302 (and other fume hoods) with time. For example, the processor 320 may calculate and store in the memory 322 or the server 316 air flow or air flow rate associated with the fume hood 302 (and other fume hoods) with time. The user may use a plurality of data analytics or data selection features (e.g., sandbox feature) provided by the system 300 to select samples, time durations, parameters, statistical functions, etc., and view fume hood usage statistics based on the selection on a user interface or an application ("app") associated with the system 300. The system 300 may also auto-generate and output energy usage reports as per state guidelines. The system 300 may also provide provision to import and analyze building management system (BMS) data associated with the lab that houses the fume hood 302. In this case, the system 300 may connect with the existing BMS, and may share the air flow data, the window open state data, etc. with the BMS. In further aspects, the user may export/download the data described herein to a spreadsheet, and upload the spreadsheet to the BMS.

In addition, the system 300 may facilitate the university/research facility to run or execute competitions based on energy usage (or other parameters) associated with each fume hood, to incentivize (and reward) users to close the window 104 after using respective fume hoods. For example, users associated with those fume hoods that use the least amount of energy or energy lower than a competition threshold over a time duration of a week, a fortnight, a month, and/or the like may be declared competition winners. The system 300 may output weekly notifications declaring names of competition winners and/or users who may be regularly performing well in the competition (e.g., the users who may be regularly closing the sash windows after using their respective fume hoods).

In further aspects, responsive to determining/calculating the first or second estimated energy usage or energy loss associated with the fume hood 302 as described above, the processor 320 may compare the first or second estimated energy usage or energy loss with a first predefined energy threshold and a second predefined energy threshold. In some aspects, the second predefined energy threshold may be greater than the first predefined energy threshold. Responsive to determining that the first or second estimated energy usage or energy loss may be less than the first predefined threshold, the processor 320 may output, e.g., via the speaker 308, the light emitter 310 and/or the user device 314, a second notification. The second notification may indicate to the user and/or the lab operator that the fume hood 302 may not be using much energy or the user may be efficiently using the fume hood 302, thereby encouraging efficient or good user behavior associated with the fume hood usage.

On the other hand, responsive to determining that the first or second estimated energy usage or energy loss may be greater than the second predefined energy threshold, the processor 320 may output, e.g., via the speaker 308, the light emitter 310 and/or the user device 314, a third notification. The third notification may indicate to the user and/or the lab operator that the fume hood 302 may be using a lot of energy and the user should regularly close the window 104 after using the fume hood 302, thereby reminding the user and/or the lab operator of best practices associated with the fume hood usage.

In additional aspects, the processor 320 may fetch/obtain historical energy usage or energy loss information associated with the fume hood 302 from the memory 322 or the server 316, and predict a future energy usage or energy loss associated with the fume hood 302 based on the historical energy usage or energy loss information. The processor 320 may then compare the predicted future energy usage or energy loss with a third predefined energy threshold. Responsive to determining that the predicted future energy usage or energy loss may be greater than the third predefined energy threshold, the processor 320 may output, e.g., via the speaker 308, the light emitter 310 and/or the user device 314, a fourth notification. The fourth notification may indicate to the user and/or the lab operator that the fume hood 302 may not have been operated in an efficient manner historically, and hence the user and/or the lab operator should ensure that the window 104 is closed after using the fume hood 302, when the fume hood 302 may be used in the future.

In further aspects, the processor 320 may be configured to enable access to the fume hood 302 based on a time of day and/or user authentication. For example, in some aspects, when the user approaches the fume hood 302 to open the window 104 and access the fume hood interior portion (e.g., to work at the fume hood 302), the processor 320 may first authenticate the user based on facial recognition, fingerprint recognition, iris recognition, password/passcode input, etc., and may enable the user to open the window 104 when the user may be authenticated. In this case, the memory 322 may pre-store the user's facial, fingerprint and/or iris features, and/or password/passcode associated with the user. The processor 320 may authenticate the user based on the inputs obtained from the detection unit 306 and the information described above that may be pre-stored in the memory 322. The processor 320 may enable access to the fume hood 302 (e.g., by automatically unlocking a lock associated with the window 104) for the user when the user may be authenticated.

The processor 320 may further enable access to the fume hood 302 based on a time of day and a fume hood booking that the user may have done, e.g., by using a Calendar feature of the system 300. For example, if the user may have booked to use the fume hood 302 between 3-4 PM, the processor 320 may enable access to the fume hood 302 for the user between 3-4 PM (and not for any other user).

When the user may be located in proximity to the fume hood 302 and using the fume hood 302 to experiment with chemicals, the processor 320 may additionally determine a time duration the user spends in actually working at the fume hood 302. In this case, the processor 320 may determine a distance between the user and the fume hood 302 (specifically, the fume hood front portion) based on the inputs obtained from the detection unit 306. Responsive to determining that the distance may be greater than a predefined distance threshold (e.g., 4-5 feet) and the user may be located at the distance greater than the predefined distance threshold for more than a predefined time duration threshold (e.g., 10-15 minutes), the processor 320 may output a fifth notification. The fifth notification may indicate to the user and/or the lab operator that while the user may be located in proximity to the fume hood 302, the user may not actually be close to the fume hood 302 and hence may not be working at the fume hood 302. In this manner, the processor 320 may assist in highlighting or alerting inefficient fume hood usage or user behavior.

The processor 320 may be further configured to determine if the user may be keeping the fume hood interior portion clean when the user leaves after using the fume hood 302. In this case, the processor 320 may obtain information associated with the real-time state of the fume hood interior portion from the detection unit 306. The processor 320 may further obtain information associated with permissible fume hood interior portion state that may be pre-stored in the memory 322 or the server 316. The processor 320 may then compare the information associated with the real-time state and the information associated with permissible fume hood interior portion state. The processor 320 may output a sixth notification when the real-time state may be different from the permissible fume hood interior portion state. For example, the processor 320 may output the sixth notification when the real-time state indicates that the fume hood interior portion may not be clean (which may be the permissible fume hood interior portion state) or some leftover chemicals may be present in the fume hood interior portion. The sixth notification may indicate to the user and/or the lab operator that the fume hood 302 may be unclean. Responsive to hearing/viewing the sixth notification, the user and/or the lab operator may clean the fume hood interior portion, thereby enhancing fume hood usage experience.

In some aspects, the system 300 may be additionally configured to determine if the detection unit 306 may be faulty (or moved or dislocated from its installed position). In this case, the system 300 may be configured to obtain periodic inputs from one or more additional sensors, different from the detection unit 306, which may be located on or in proximity to the fume hood 302. The system 300 may correlate inputs obtained from the detection unit 306 and the additional sensors, and determine if the detection unit 306 may be faulty or dislocated if the inputs do not correlate or if the inputs differ. Responsive to such determination, the system 300 may output maintenance notifications to the user and/or the lab operator to repair the detection unit 306.

Figure 5:
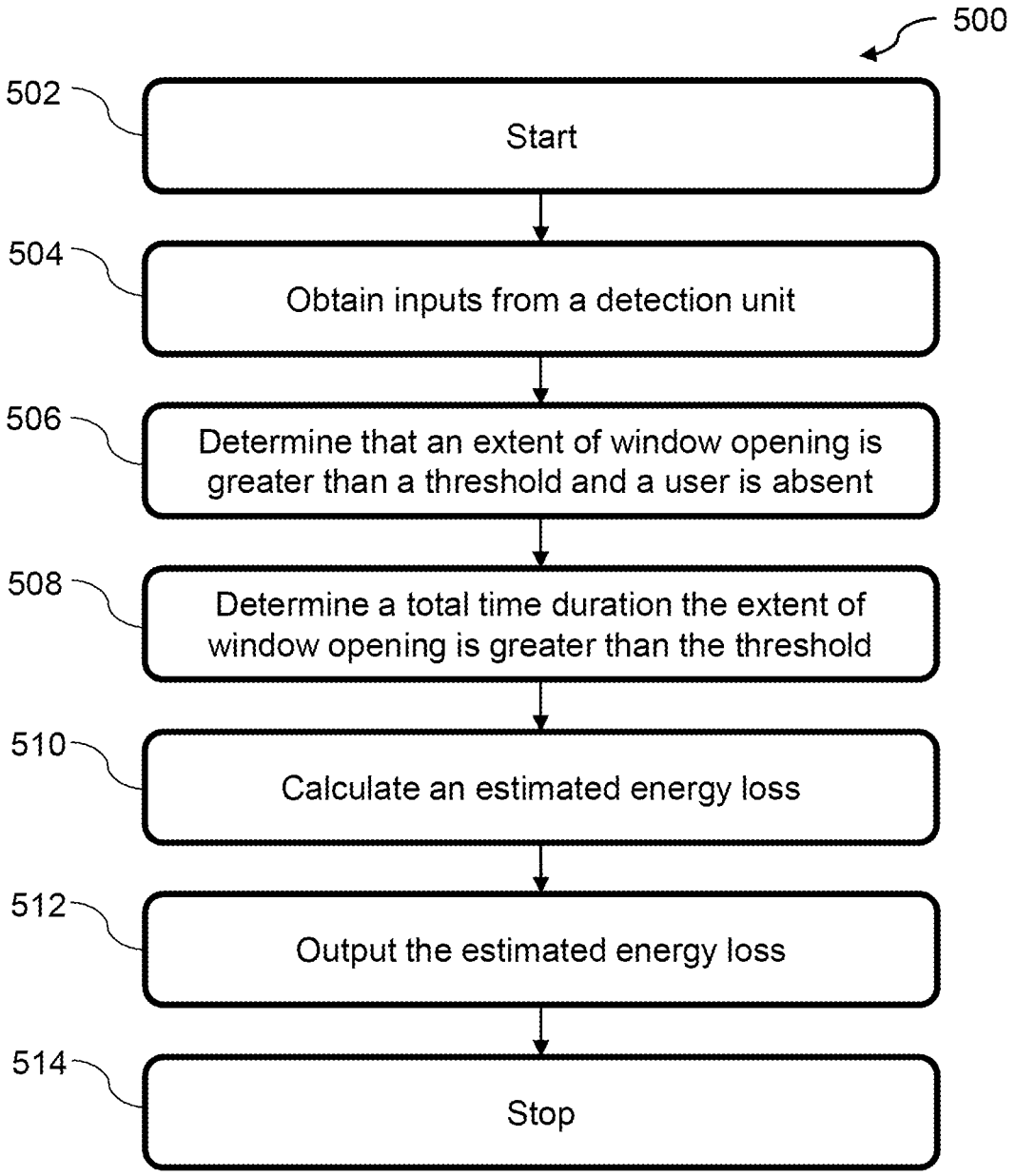
FIG. 5 depicts a flow diagram of an example method to optimize fume hood energy usage in accordance with the present disclosure.

FIG. 5 depicts a flow diagram of an example method 500 to optimize fume hood energy usage in accordance with the present disclosure. FIG. 5 may be described with continued reference to prior figures. The following process is exemplary and not confined to the steps described hereafter. Moreover, alternative embodiments may include more or less steps than are shown or described herein and may include these steps in a different order than the order described in the following example embodiments.

Referring to FIG. 5, at step 502, the method 500 may commence. At step 504, the method 500 may include obtaining, by the processor 320, the inputs from the detection unit 306. At step 506, the method 500 may include determining, by the processor 320, that the extent of open state associated with the window 104 (or the extent of window opening) may be greater than the predefined threshold (e.g., the first predefined threshold) for the predefined time duration and a user absence from the proximity to the fume hood 302 based on the obtained inputs.

At step 508, the method 500 may include determining, by the processor 320, the total time duration (e.g., the first total time duration) for which the extent of window opening may be greater than the predefined threshold, responsive to a determination that the extent of window opening may be greater than the predefined threshold for the predefined time duration and the user may not be present in proximity to the fume hood 302.

At step 510, the method 500 may include calculating, by the processor 320, the estimated energy usage or energy loss (e.g., the first estimated energy usage or energy loss) associated with the fume hood 302 based on the extent of window opening and the total time duration. At step 512, the method 500 may include outputting/transmitting, by the processor 320, the estimated energy usage or energy loss.

At step 514, the method 500 may stop.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

Further, where appropriate, the functions described herein can be performed in one or more of hardware, software, firmware, digital components, or analog components. For example, one or more application specific integrated circuits (ASICs) can be programmed to carry out one or more of the systems and procedures described herein. Certain terms are used throughout the description and claims refer to particular system components. As one skilled in the art will appreciate, components may be referred to by different names. This document does not intend to distinguish between components that differ in name, but not function.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Computing devices may include computer-executable instructions, where the instructions may be executable by one or more computing devices such as those listed above and stored on a computer-readable medium.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc. should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A system to optimize energy usage comprising:

a transceiver configured to receive inputs from a detection unit, wherein the detection unit is configured to detect an extent of open state of a window associated with an enclosure and a presence of a user in proximity to the enclosure;

a processor communicatively coupled with the transceiver, wherein the processor is configured to:

obtain the inputs from the transceiver;

determine that the extent of open state is greater than a first predefined threshold for a predefined time duration and an absence of the user in proximity to the enclosure for the predefined time duration based on the inputs;

determine a first total time duration the extent of open state is greater than the first predefined threshold, responsive to a determination that the extent of open state is greater than the first predefined threshold for the predefined time duration and the user is not present in proximity to the enclosure;

calculate a first estimated energy loss associated with the enclosure based on the extent of open state and the first total time duration; and output the first estimated energy loss.

2. The system of claim 1, wherein the processor is further configured to output a first notification responsive to the determination that the extent of open state is greater than the first predefined threshold for the predefined time duration and the user is not present in proximity to the enclosure.

3. The system of claim 2, wherein the processor outputs the first notification via a speaker and/or a light emitter associated with the enclosure.

4. The system of claim 2, wherein the processor outputs the first notification to a user device via the transceiver.

5. The system of claim 1, wherein the processor is further configured to:

determine that the extent of open state is greater than a second predefined threshold for the predefined time duration and the presence of the user in proximity to the enclosure for the predefined time duration based on the inputs;

determine a second total time duration the extent of open state is greater than the second predefined threshold, responsive to a determination that the extent of open state is greater than the second predefined threshold for the predefined time duration and the user is present in proximity to the enclosure;

calculate a second estimated energy loss associated with the enclosure based on the extent of open state and the second total time duration; and output the second estimated energy loss.

6. The system of claim 1, wherein the detection unit comprises at least one of an ultrasonic sensor, an infrared sensor, a time of flight (TOF) sensor, a Red-Green-Blue (RGB) camera, an infrared camera, an accelerometer, a linear encoder, and a Light Detection and Ranging (lidar) sensor.

7. The system of claim 1, wherein the enclosure is a fume hood, and wherein the window is a sash window.

8. The system of claim 1, wherein the window is configured to provide access to an enclosure interior portion via an enclosure opening in an open state of the window.

9. The system of claim 1, wherein the processor is further configured to:

determine an air flow rate from the enclosure based on the extent of open state and the first total time duration; and determine the first estimated energy loss associated with the enclosure based on the air flow rate.

10. The system of claim 9, wherein the transceiver is further configured to receive information associated with a real-time temperature in proximity to the enclosure from a temperature sensor, and wherein the processor is further configured to determine the first estimated energy loss based on the real-time temperature.

11. The system of claim 1, wherein the processor is further configured to:

determine that the first estimated energy loss is less than a first predefined energy threshold;

output a second notification responsive to determining that the first estimated energy loss is less than the first predefined energy threshold;

determine that the first estimated energy loss is greater than a second predefined energy threshold; and output a third notification responsive to determining that the first estimated energy loss is greater than the second predefined energy threshold.

12. The system of claim 1, wherein the processor is further configured to:

obtain historical energy loss information associated with the enclosure;

predict a future energy loss associated with the enclosure based on the historical energy loss information;

determine that the future energy loss is greater than a third predefined energy threshold; and output a fourth notification responsive to determining that the future energy loss is greater than the third predefined energy threshold.

13. The system of claim 1, wherein the processor is further configured to:

authenticate the user based on the inputs obtained from the detection unit; and enable access to the enclosure for the user responsive to authenticating the user.

14. The system of claim 1, wherein the detection unit is further configured to detect a real-time state of an enclosure interior portion.

15. The system of claim 14, wherein the processor is further configured to:

obtain information associated with the real-time state from the detection unit;

obtain a permissible state of the enclosure interior portion;

compare the real-time state with the permissible state; and output a fifth notification when the real-time state is different from the permissible state.

16. A method to optimize energy usage comprising:

obtaining, by a processor, inputs from a detection unit, wherein the detection unit is configured to detect an extent of open state of a window associated with an enclosure and a presence of a user in proximity to the enclosure;

determining, by the processor, that the extent of open state is greater than a first predefined threshold for a predefined time duration and an absence of the user in proximity to the enclosure for the predefined time duration based on the inputs;

determining, by the processor, a first total time duration the extent of open state is greater than the first predefined threshold, responsive to a determination that the extent of open state is greater than the first predefined threshold for the predefined time duration and the user is not present in proximity to the enclosure;

calculating, by the processor, a first estimated energy loss associated with the enclosure based on the extent of open state and the first total time duration; and outputting, by the processor, the first estimated energy loss.

17. The method of claim 16 further comprising outputting a first notification responsive to the determination that the extent of open state is greater than the first predefined threshold for the predefined time duration and the user is not present in proximity to the enclosure.

18. The method of claim 16, wherein the detection unit comprises at least one of an ultrasonic sensor, an infrared sensor, a time of flight (TOF) sensor, an infrared camera, an accelerometer, a linear encoder, a Red-Green-Blue (RGB) camera, and a Light Detection and Ranging (lidar) sensor.

19. The method of claim 16 further comprising:

determining that the extent of open state is greater than a second predefined threshold for the predefined time duration and the presence of the user in proximity to the enclosure for the predefined time duration based on the inputs;

determining a second total time duration the extent of open state is greater than the second predefined threshold, responsive to a determination that the extent of open state is greater than the second predefined threshold for the predefined time duration and the user is present in proximity to the enclosure;

calculating a second estimated energy loss associated with the enclosure based on the extent of open state and the second total time duration; and outputting the second estimated energy loss.

20. A non-transitory computer-readable storage medium in a distributed computing system, the non-transitory computer-readable storage medium having instructions stored thereupon which, when executed by a processor, cause the processor to:

obtain inputs from a detection unit, wherein the detection unit is configured to detect an extent of open state of a window associated with an enclosure and a presence of a user in proximity to the enclosure;

determine that the extent of open state is greater than a predefined threshold for a predefined time duration and an absence of the user in proximity to the enclosure for the predefined time duration based on the inputs;

determine a total time duration the extent of open state is greater than the predefined threshold, responsive to a determination that the extent of open state is greater than the predefined threshold for the predefined time duration and the user is not present in proximity to the enclosure;

calculate an estimated energy loss associated with the enclosure based on the extent of open state and the total time duration; and output the estimated energy loss.

* * * * *